US008869324B1

(12) United States Patent
Lin

(10) Patent No.: US 8,869,324 B1
(45) Date of Patent: Oct. 28, 2014

(54) BED PANEL STRUCTURE

(71) Applicant: Kuan-Meng Lin, Chiayi (TW)

(72) Inventor: Kuan-Meng Lin, Chiayi (TW)

( * ) Notice: Subject to any disclaimer, the term of this patent is extended or adjusted under 35 U.S.C. 154(b) by 6 days.

(21) Appl. No.: 13/875,353

(22) Filed: May 2, 2013

(51) Int. Cl.
*A47C 19/02* (2006.01)
*A47C 19/00* (2006.01)

(52) U.S. Cl.
CPC ..... *A47C 19/005* (2013.01); *A47C 19/02* (2013.01); *A47C 19/021* (2013.01)
USPC ..... 5/400; 5/200.1; 5/288; 5/296

(58) Field of Classification Search
CPC .... A47C 19/005; A47C 19/02; A47C 19/021; A47C 19/024; A47C 19/025
USPC ..... 5/400, 200.1, 201, 282.1, 285, 286, 5/288, 290, 296
See application file for complete search history.

(56) References Cited

U.S. PATENT DOCUMENTS 4,128,907 A * 12/1978 Gelbart ..... 5/200.1
5,099,529 A * 3/1992 Anderson ..... 5/400
5,522,101 A * 6/1996 Yeh ..... 5/9.1
5,694,656 A * 12/1997 Huang ..... 5/290
7,600,278 B2 * 10/2009 Oh ..... 5/201
7,721,366 B2 * 5/2010 Lee et al. ..... 5/201
8,056,159 B2 * 11/2011 Lee et al. ..... 5/201
8,316,485 B2 * 11/2012 Lee et al. ..... 5/201
8,621,685 B2 * 1/2014 Jin ..... 5/110
2009/0100597 A1 * 4/2009 Oh ..... 5/176.1
2009/0193583 A1 * 8/2009 Lee et al. ..... 5/176.1
2010/0138994 A1 * 6/2010 Lee et al. ..... 5/400
2010/0146910 A1 * 6/2010 Lee et al. ..... 53/473
2011/0219537 A1 * 9/2011 Lin ..... 5/9.1
2012/0017370 A1 * 1/2012 Lee et al. ..... 5/400
2012/0222216 A1 * 9/2012 Jin ..... 5/400

* cited by examiner

*Primary Examiner* — Robert G Santos
(74) *Attorney, Agent, or Firm* — Alan Kamrath; Kamrath IP Lawfirm, P.A.

(57) ABSTRACT

A bed panel structure contains a body including two bed frames and the two bed frames are a left bed frame and a right bed frame. Each bed frame has a plurality of rods defined between an outer support and an inner support, and each inner support has a plurality of through holes and plural screwing orifices, each outer support has a plurality of notches corresponding to the plurality of through holes so that each end of a respective one of a plurality of shafts is retained in each notch via each through hole, and a respective one of a plurality of C-shaped retainers connects with each screwing orifice of the inner supports, thus assembling the body.

2 Claims, 5 Drawing Sheets

BED PANEL STRUCTURE

BACKGROUND OF THE INVENTION

1. Field of the Invention

The present invention relates to a bed panel structure, and more particularly to a bed body comprised of two symmetrical bed frames.

2. Description of the Prior Art

A conventional bed panel is fixed between a front leg rack and a rear leg rack so as to hold a bed, hence a size of the bed panel is large so as to provide sufficient loading stability. However, such a conventional bed panel is in a large size, thus increasing shipping inconvenience and cost.

Also, the conventional bed panel has a front part and a rear part folded and hinged together, but such a hinge arrangement is fixed on a middle portion of the bed panel, so the middle portion falls and deforms easily after expending the front part and the rear part, thereby decreasing support strength of the conventional bed panel.

The present invention has arisen to mitigate and/or obviate the afore-described disadvantages.

SUMMARY OF THE INVENTION

The primary object of the present invention is to provide a bed panel structure that in assembly of a body, two ends of each shaft are retained in any two opposite notches of two bed frames via any two opposite through holes of the two bed frames so as to enhance a loading capacity and a structural stability of the body by increasing two inner supports. In addition, the two inner supports are capable of decreasing force torque of a plurality of rods (i.e., decreasing a half of force torque of the conventional bed panel) so as to enhance loading strength of the plurality of rods and support stability of the bed panel structure.

Further object of the present invention is to provide a bed panel structure in which each C-shaped retainer connects with each screwing orifice after a respective one of plural bolts inserts through any two opposite screwing orifices of the two inner supports and screws with a respective one of a plurality of nuts, such that the two bed frames are connected together, and the each shaft does not disengages from the two bed frames, thus preventing the body from deformation and reinforcing the body.

Another object of the present invention is to provide a bed panel structure in which the body is comprised of the two bed frames so as to save production, packing, and shipping cost and space/size.

To obtain the above objectives, a bed panel structure contains:

A bed panel structure contains a body including two bed frames, and the two bed frames are a left bed frame and a right bed frame. Each bed frame has a plurality of rods defined between an outer support and an inner support, and the inner support has a plurality of through holes and plural screwing orifices, the outer support has a plurality of notches corresponding to the plurality of through holes so that each end of a respective one of plural shafts is retained in each notch via each through hole, and a respective one of a plurality of C-shaped retainers connects with each screwing orifice of the inner support, thus assembling the body.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
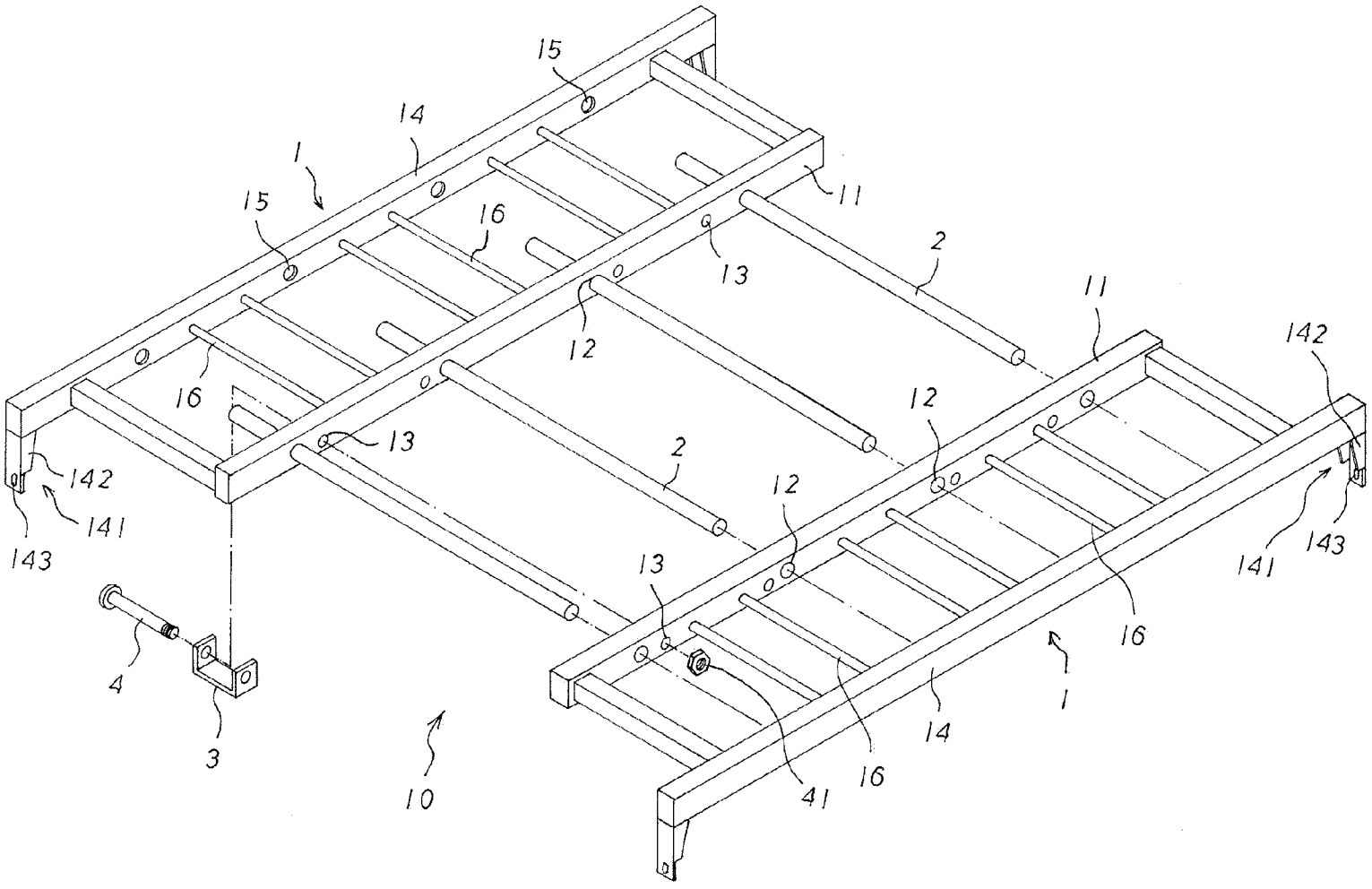
FIG. 1 is a perspective view of the exploded components showing a bed panel structure according to a preferred embodiment of the present invention.
Figure 2:
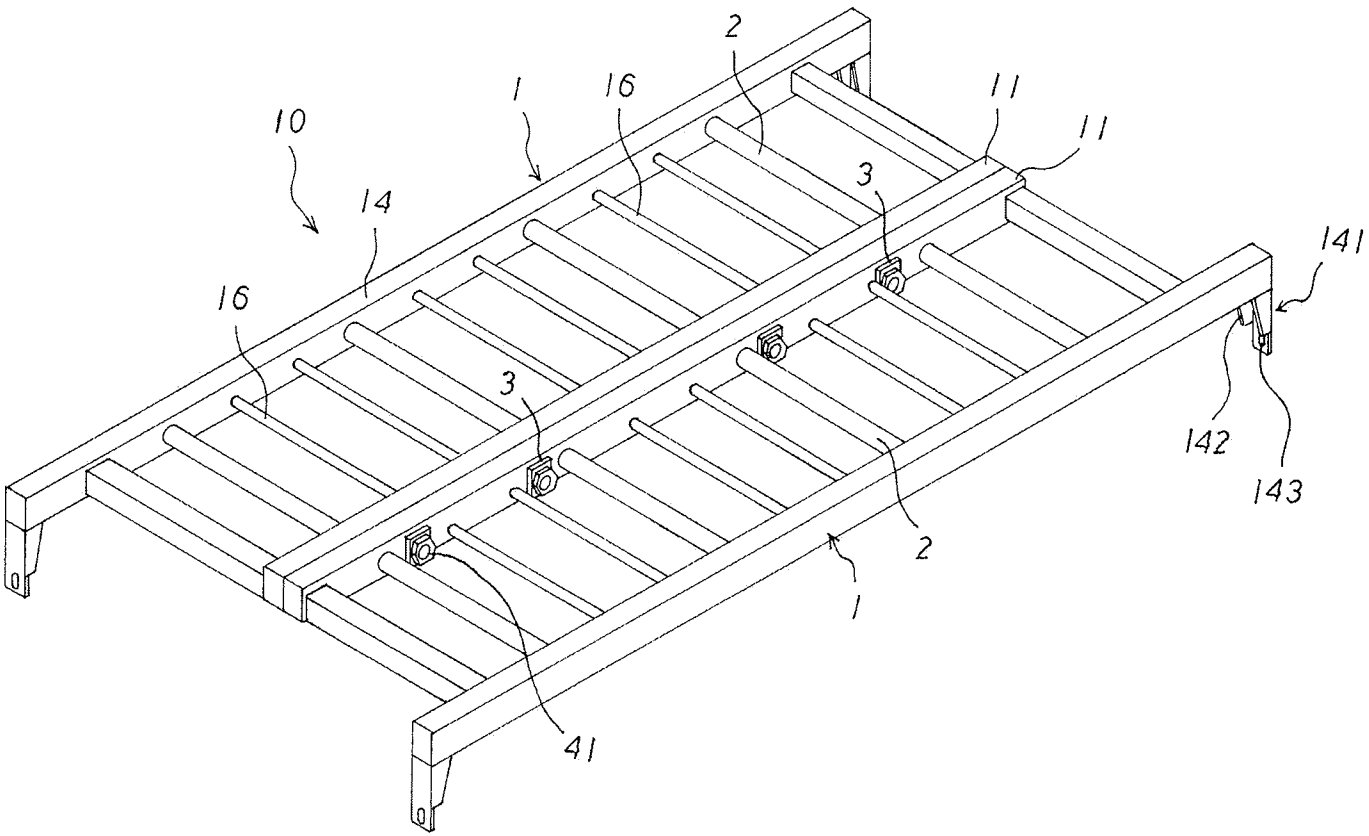
FIG. 2 is a perspective view of the assembly showing the bed panel structure according to the preferred embodiment of the present invention.

A bed panel structure according to a preferred embodiment of the present invention comprises: a body 10 including two bed frames 1, i.e., a left bed frame and a right frame, (as shown in FIG. 1), wherein each bed frame 1 has a plurality of rods 16 defined between an outer support 14 and an inner support 11, and each inner support 11 has a plurality of through holes 12 and plural screwing orifices 13, each outer support 14 has a plurality of notches 15 corresponding to the plurality of through holes 12 so that each end of a respective one of a plurality of shafts 2 is retained in each notch 15 via each through hole 12, and a respective one of a plurality of C-shaped retainers 3 connects with each screwing orifice 13 of the inner supports 11, thus assembling the body 10 (as illustrated in FIG. 2).

Figure 3:
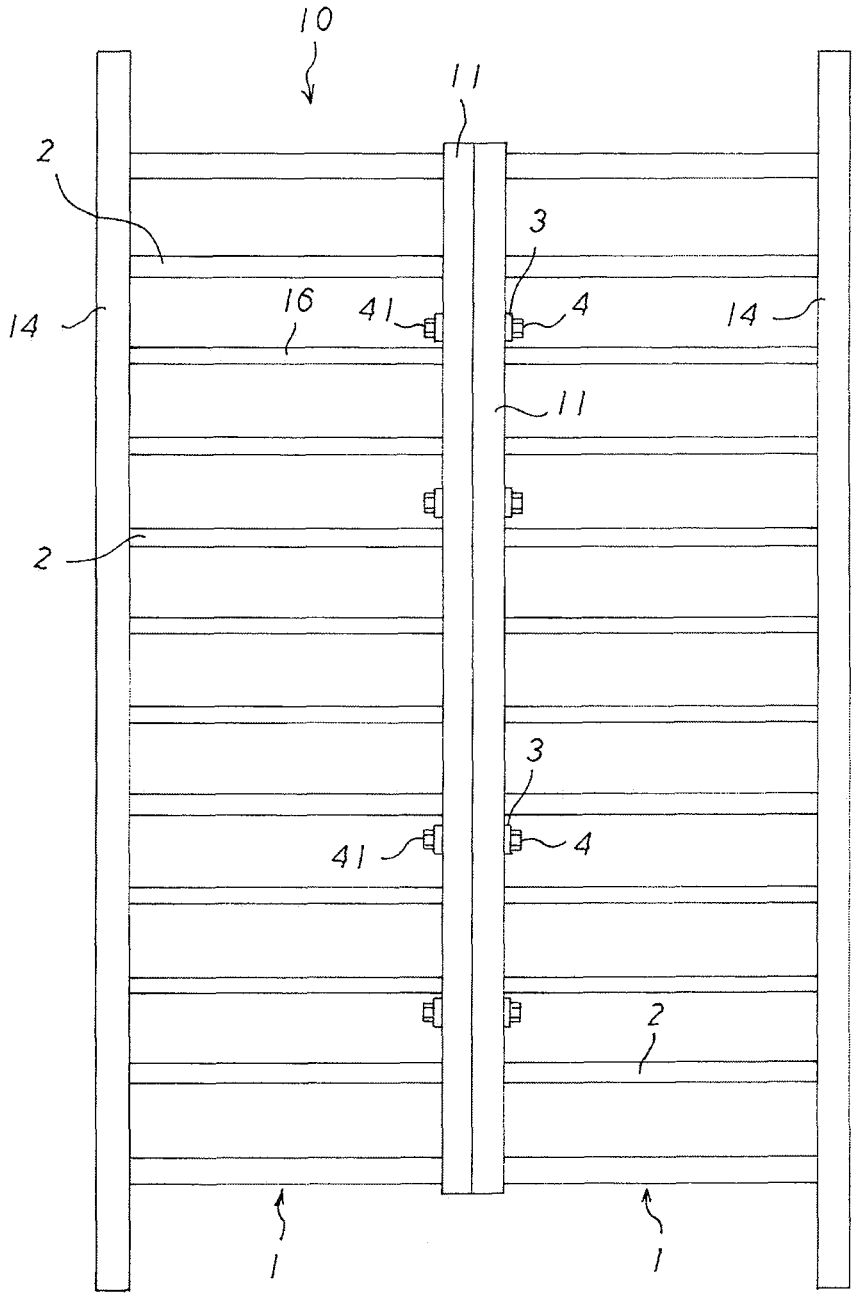
FIG. 3 is a top plan view of the assembly showing the bed panel structure according to the preferred embodiment of the present invention.

In assembly of the body 10, two ends of each shaft 2 are retained in any two opposite notches 15 of the two bed frames 1 via any two opposite through holes 12 of the two bed frames 1 so as to enhance a loading capacity and a structural stability of the body 10. Also, each C-shaped retainer 3 connects with the each screwing orifice 13 after a respective one of plural bolts 4 inserts through any two opposite screwing orifices 13 of two inner supports 11 and screws with a respective one of a plurality of nuts 41 (as shown in FIG. 3), such that the two bed frames 1 are connected together, and the each shaft 2 does not disengages from the two bed frames 1, thus preventing the body 10 from deformation and reinforcing the body 10.

It is to be noted that a size of the each shaft 2 is larger than each rod 16 so as to enhance support strength.

Figure 4:
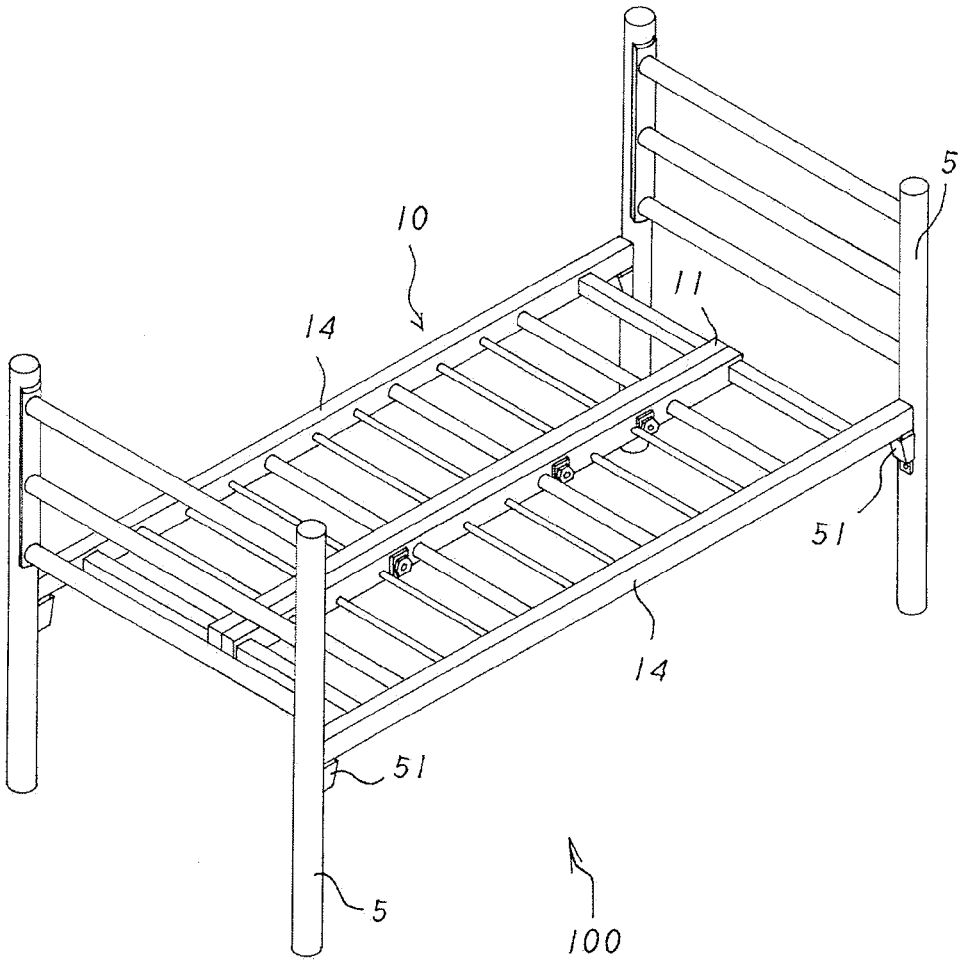
FIG. 4 is a perspective view of the application showing the bed panel structure according to the preferred embodiment of the present invention.
Figure 5:
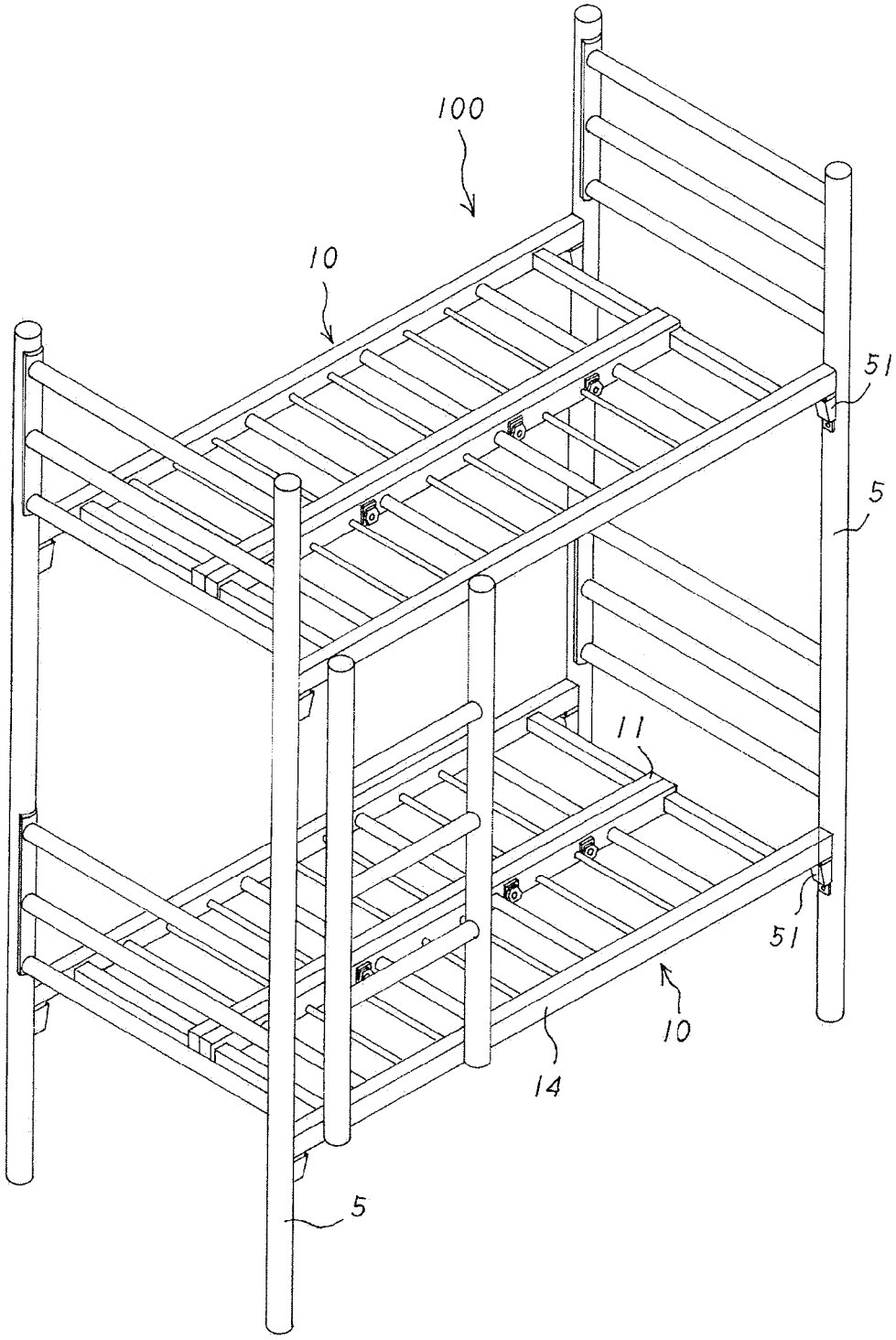
FIG. 5 is another perspective view of the application showing the bed panel structure according to the preferred embodiment of the present invention.

Furthermore, each outer support 14 has a fixing piece 141 extending downwardly from end portions thereof, and the fixing piece 141 has a wedged latch 142 extending downwardly therefrom and an elongated aperture 143 defined on a lower end of the fixing piece 141 (as shown in FIG. 1). Referring further to FIGS. 4 and 5, a leg rack 5 has at least one wedged recess 51 so as to retain the fixing piece 141, such that the body 10 connects with the leg rack 5, thereby assembling a bed 100 (such as a single-layer bed or a bunk bed).

Accordingly, the body 10 is comprised of the two bed frames 1 so as to save production, packing, and shipping cost and space/size. In addition, the body 10 is reinforced. Also, a size of the body 10 is not limited, i.e., the size of the body 10 is increased by connecting at least two bed frames 1 together. For example, three bed frames 1 are connected together to obtain the body 10.

While we have shown and described various embodiments in accordance with the present invention, it is clear to those skilled in the art that further embodiments may be made without departing from the scope of the present invention.

What is claimed is:

1. A bed panel structure comprising:

a body including two bed frames, and the two bed frames being a left bed frame and a right bed frame, wherein each bed frame has a plurality of rods defined between an outer support and an inner support, and each inner support has a plurality of through holes and plural screwing orifices, each outer support has a plurality of notches corresponding to the plurality of through holes so that each end of a respective one of a plurality of shafts is retained in each notch via each through hole, and a respective one of a plurality of C-shaped retainers connects with each screwing orifice of the inner supports, thus assembling the body.

2. The bed panel structure as claimed in claim 1, wherein each other support has a fixing piece extending downwardly from end portions thereof, and the fixing piece has a wedged latch extending downwardly therefrom and an elongated aperture defined on a lower end of the fixing piece, and a leg rack has at least one wedged recess so as to retain the fixing piece, such that the body connects with the leg rack, thereby assembling a bed.

* * * * *